US006123186A

United States Patent [19]

Schwerdtfeger et al.

[11] Patent Number: 6,123,186

[45] Date of Patent: Sep. 26, 2000

[54] SUPPORTING ARRANGEMENT FOR THIN STRIP CASTING

[75] Inventors: Klaus Schwerdtfeger, Goslar; Karl-Heinz Spitzer, Clausthal-Zellerfeld; Wolfgang Reichelt; Ulrich Urlau, both of Moers; Ewald Feuerstacke, Dorsten; Joachim Kroos, Meine, all of Germany

[73] Assignee: Mannesmann AG, Düsseldorf, Germany

[21] Appl. No.: 09/194,843

[22] PCT Filed: Jun. 3, 1997

[86] PCT No.: PCT/DE97/01150

§ 371 Date: Feb. 17, 1999

§ 102(e) Date: Feb. 17, 1999

[87] PCT Pub. No.: WO97/47411

PCT Pub. Date: Dec. 18, 1997

[30] Foreign Application Priority Data

Jun. 7, 1996 [DE] Germany ..... 196 22 929

[51] Int. Cl.[7] ..... B65G 23/18

[52] U.S. Cl. ..... 198/811; 198/689.1

[58] Field of Search ..... 198/493, 688.1, 198/689.1, 811, 837, 841

[56] References Cited

U.S. PATENT DOCUMENTS

| | | | |
|---|---|---|---|
| 3,933,193 | 1/1976 | Baker et al. | 164/146 |
| 4,316,718 | 2/1982 | Drugge | 198/811 X |

FOREIGN PATENT DOCUMENTS

| | | |
|---|---|---|
| 8901 | 3/1980 | European Pat. Off. . |
| 2382297 | 9/1978 | France . |

OTHER PUBLICATIONS

Production of Steel Strip With a Single–Belt Process, Schwerdtfeger and Spitzer, Apr. 1995.

*Primary Examiner*—James R. Bidwell
*Attorney, Agent, or Firm*—Cohen, Pontani, Lieberman & Pavane

[57] ABSTRACT

A supporting arrangement for the transport belt in thin strip casting plants. The liquid steel is cast onto the circulating transport belt. On its underside, the transport belt has devices for generating a negative pressure and for supporting the belt as well as for cooling. In the past, rollers were used for supporting the belt. Between the supporting points of the belt on the rollers, upward curvatures of the belt may occur. This is avoided by the use of supports of which the spacings measured transversely to the transporting direction are greater than the lengths of the supports in this direction.

6 Claims, 2 Drawing Sheets

SUPPORTING ARRANGEMENT FOR THIN STRIP CASTING

BACKGROUND OF THE INVENTION

1. Field of the Invention

The invention relates to special arrangements of supports in thin strip casting plants.

2. Discussion of the Prior Art

A thin strip casting plant refers here to a plant in which the liquid steel is transported via a feeding system to a circulating belt which is cooled from below by water. The underside of the applied layer of steel then solidifies in contact with the belt and the upper side solidifies as a free surface under inert gas or, to achieve better surface properties, in contact with an upper roller. After solidifying completely, the strand (thin strip) produced leaves the circulating transport belt and is transported further by a driver. The casting thickness of the strip (about 10 mm) can be chosen largely optimally for the required thickness of the finish-rolled hot strip (1 to 3 mm) and the required hot deformation for achieving adequate material properties. The optimum casting thickness is in this case the thickness at which the required degree of hot deformation is achieved with as little deformation work as possible.

The circulating transport belt makes it possible for the strand to be cooled and supported largely without friction over a long distance. This results in a high casting rate, which is a prerequisite for a direct coupling between the casting plant and the rolling stage, and high productivity as a basic condition for the casting of ordinary steels.

The circulating belt, accessible from above and the front, makes it easier for the steel to be fed in. Unlike in other processes, the steel does not have to be guided into a narrow gap between two belts or rolls.

In the area between the conveying rollers for the circulating belt, a cooling device (water cooling with suitable nozzles) is arranged on the side of the circulating belt facing away from the steel, for cooling said belt. In spite of this cooling, the high temperatures applied to the upper side of the belt by the steel melt cause the circulating belt to curve upward. This upward curvature results in the strand also being shaped in its upper surface. To avoid the upward curvature, a negative pressure is set in the cooler. The difference in pressure causes the circulating belt to be pressed onto supports.

The supporting rollers used in the past (See Production of steel strip with a single-belt process, K.-H. Spitzer and K. Schwertfeger, ISM November 1995, page 51) exhibited in the past a longitudinal section with grooves which (FIG. 12 of the publication) had supporting rollers, that is to say a profiled surface, the profile having in a longitudinal section portions of larger diameter than the minimum roller diameter. The width of these spacings corresponded in the past substantially to the distance between the portions.

In the case of such roller designs, it was not possible for the particularly thermally induced stresses in the circulating transport belt to be reduced in a controlled manner. As soon as the stability limit is exceeded by excessive stresses, the circulating belt curves up with a particular tendency in the central area. The negative pressure which has been set thus does not lead to the desired result in the case of the roller design used in the past, since the upward curvature of the circulating belt continues to influence the shape of the strand in an undesired way.

SUMMARY OF THE INVENTION

The object of the invention is to provide a design of support and a supporting arrangement in which the upward curvature of the circulating belt is avoided, in particular in the area of liquid steel feeding.

Pursuant to this object, and others which will become apparent hereafter, one aspect of the present invention resides in a supporting arrangement comprising supports having a skid-shaped design and arranged in a region of the side of the transporting belt under negative pressure. The supports are spaced, in a direction transverse to a transporting direction of the transport belt, at a distance greater than a length of the supports in this direction.

According to the invention, the supports are in particular of a skid-shaped design in the region of the surface of the transport belt. The spacings of the supports, measured transversely with respect to the transporting direction, are greater than the length of the supports in this direction. The spacings are at the same time optimized in such a way that, on the one hand, the stresses in the belt can be sufficiently reduced and, on the other hand, an upward curvature of the belt over a number of supports cannot take place. In the intermediate space between the supports, the rigidity of the belt is great enough to allow essentially no upward curvature of the belt to take place. In particular, any upward curvature is also avoided by the belt being kept substantially in one plane between the supports by the negative pressure acting on the underside of the belt.

The length of the supports in the circulating direction of the transport belt is preferably greater than in the transverse direction. Together with the negative pressure acting on the underside of the transport belt, the supports have the effect that the belt is more securely restrained, as a result of which the immunity to upward curvature of the belt is increased.

In particular, the supports are arranged substantially in the plane of the underside of the transport belt in a grid-like manner, the grid axes preferably being oblique to the transporting direction, in particular at an angle of 45° to the latter. This produces a more favorable distribution of the stresses within the transport belt over its surface area. This is because the greatest stress components are no longer oriented in the transverse direction of the belt, so that upward curvature can no longer occur in this direction.

For cooling the transport belt, the nozzles for the cooling medium are arranged in the intermediate spaces in the grid, that is to say between the supports. In this way, the critical area of the belt surface between the supports in particular can be cooled more intensely. Unlike when using supporting rollers, the space between the supports is more easily accessible for the arrangement of nozzles for cooling media, since the supports can be extended downward far enough to create sufficient space for the necessary cooling media.

BRIEF DESCRIPTION OF THE DRAWINGS

The supports may be planar on their surface facing the transport belt. In particular, on this surface there may also be provided a coating which minimizes the friction in the tribological system comprising the surface of the transport belt, and the surface of the supports and the cooling medium. In particular, the surface of the supports may be formed by one or more rollers mounted on the support.

DETAILED DESCRIPTION OF THE PREFERRED EMBODIMENTS

In the supports according to the invention nozzles for cooling the transport belt are preferably integrated. These may on the one hand be the nozzles which cool the intermediate spaces between the supports. On the other hand, independently of this, the conductance of cooling medium to the surface of the supports in the region of the underside of the transport belt may be disposed in the support itself. This provides a simply designed possible means of cooling the belt directly even at the supporting surface of the supports and of producing a sliding film between support and belt. In particular, this supporting surface is substantially planar, which is intended also to include a cylindrical surface, and cooling-medium conducting channels are arranged in this surface of the supports.

In a further preferred configuration, at the individual support there may be arranged a plurality of nozzles, which are taken in particular up to the surface of the support on the underside of the transport belt.

Figure 1:
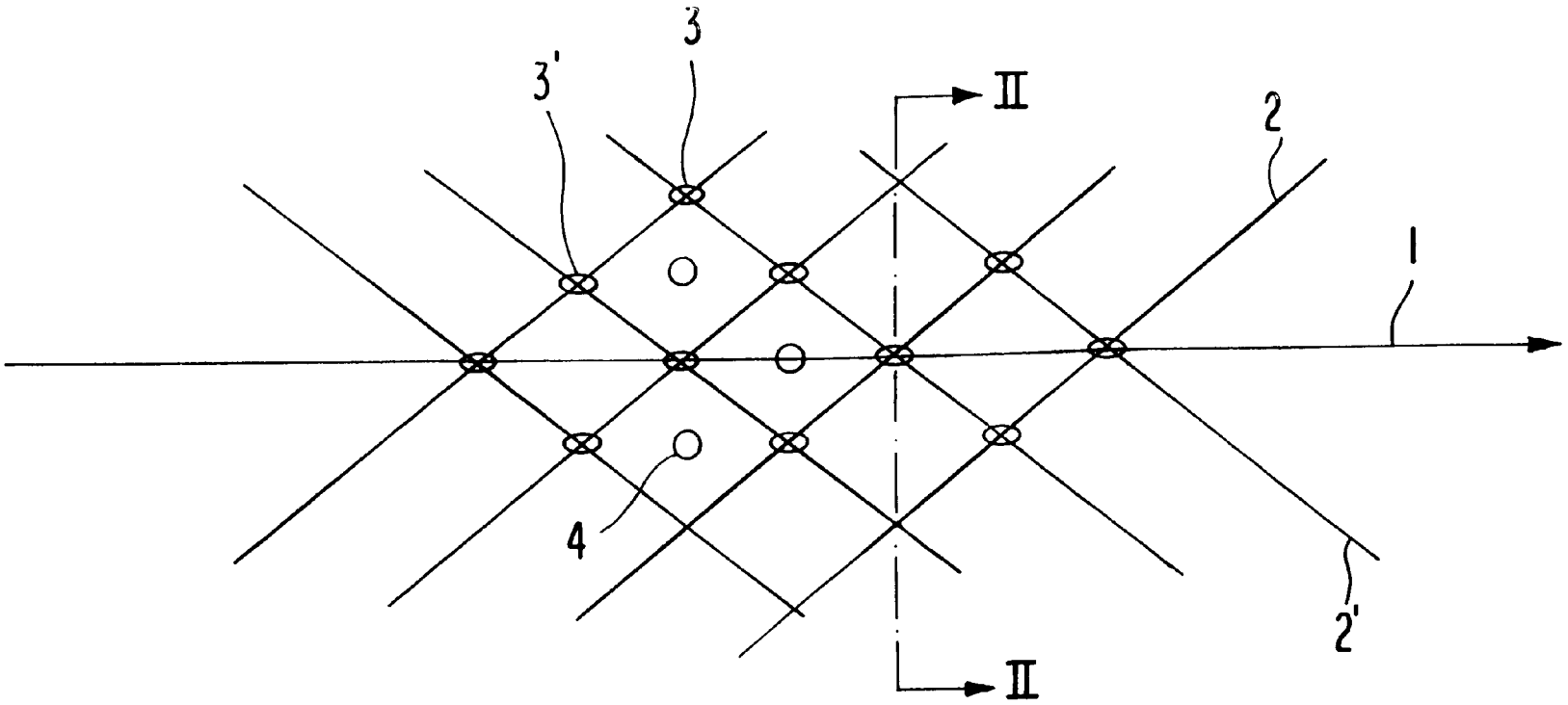
Figure 2:
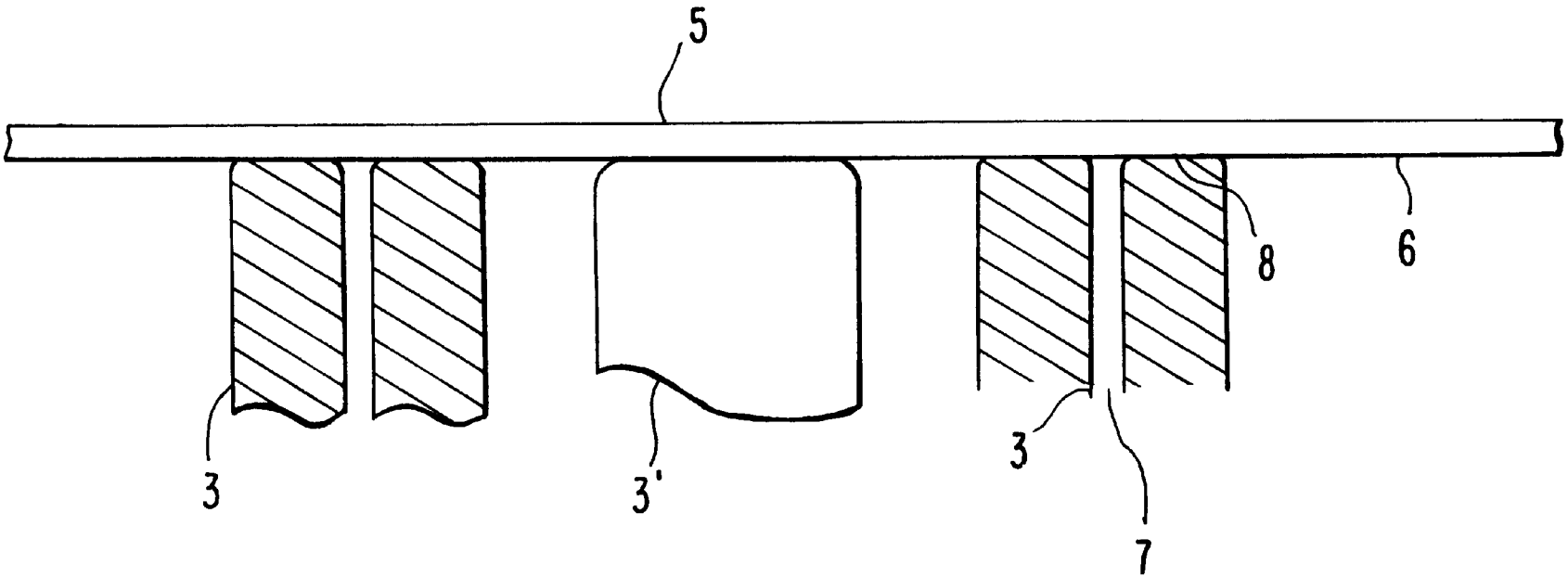

The invention is explained in more detail on the basis of an exemplary embodiment schematically represented in FIGS. 1 and 2, in which:

FIG. 1 shows a plan view of the supporting arrangement beneath the transport belt;

FIG. 2 shows a detail transversely to the transporting direction.

According to FIG. 1, the supports 3, 3' form a grid with the grid axes 2, 2', the grid axes 2, 2' being oblique to the transporting direction 1 of the circulating transport belt. The supports 3, 3' are arranged at the intersections of the grid axes 2, 2'. The nozzles 4 for supplying the cooling medium are arranged in the intermediate spaces between the supports 3, 3'.

In FIG. 2, the supports 3, 3' reaching up to the underside 6 of the transport belt 5 are shown, the nozzle 4 not being depicted for the sake of overall clarity. The supports 3, 3' have conducting channels 7 for supplying cooling medium into the region of the underside 6 of the transporting belt. As a result, a film of cooling medium can form between the upper surface 8 of the supports 3, 3 and the underside 6 of the transporting belt 5, preventing friction between these surfaces.

Water is regularly used as the cooling medium. To increase heat removal, however, two-phase cooling systems for the supports and nozzles also come into consideration. In this case, the support may be preferably cooled by air or by inert gas.

What is claimed is:

1. A supporting arrangement for a transport belt having a side under negative pressure in a thin strip casting plant, the supporting arrangement comprising supports having a skid-shaped design and arranged in a region of the side under negative pressure of the transport belt, the supports being spaced in a direction transverse to a transporting direction of the transport belt at a distance greater than a length of the supports in the transverse direction.

2. A supporting arrangement as defined in claim 1, wherein the length of the supports in the transporting direction of the transport belt is greater than in the transverse direction.

3. A supporting arrangement as defined in claim 1, wherein the supports are arranged in a grid-like pattern substantially in a plane of a surface of the transport belt.

4. A supporting arrangement as defined in claim 3, wherein the grid-like pattern has grid axes that are oblique, at an angle of 45°, to the transporting direction.

5. A supporting arrangement as defined in claim 3, and further comprising nozzles arranged in intermediate spaces of the grid for cooling the transport belt.

6. A supporting arrangement as defined in claim 1, wherein the supports each have a surface in the region of a surface of the transport belt on the negative pressure side that is substantially planar and has cooling-medium conducting channels therein.

* * * * *